US008026892B2

(12) United States Patent
Hong

(10) Patent No.: US 8,026,892 B2
(45) Date of Patent: Sep. 27, 2011

(54) LIQUID CRYSTAL DISPLAY AND DRIVING METHOD THEREOF

(75) Inventor: Hyung Ki Hong, Seoul (KR)

(73) Assignee: LG Display Co., Ltd., Seoul (KR)

( * ) Notice: Subject to any disclaimer, the term of this patent is extended or adjusted under 35 U.S.C. 154(b) by 1214 days.

(21) Appl. No.: 11/451,070

(22) Filed: Jun. 12, 2006

(65) Prior Publication Data

US 2007/0146283 A1 Jun. 28, 2007

(30) Foreign Application Priority Data

Dec. 27, 2005 (KR) ..... 10-2005-0130802

(51) Int. Cl.
*G09G 3/36* (2006.01)

(52) U.S. Cl. ..... 345/100; 345/87

(58) Field of Classification Search ..... 345/87–103, 345/109, 209, 204
See application file for complete search history.

(56) References Cited

U.S. PATENT DOCUMENTS

| | | | | |
|---|---|---|---|---|
| 7,113,158 | B1 * | 9/2006 | Fujiwara et al. | 345/87 |
| 2004/0036821 | A1 * | 2/2004 | Paukshto et al. | 349/74 |
| 2004/0041781 | A1 * | 3/2004 | Sato et al. | 345/102 |
| 2004/0257323 | A1 * | 12/2004 | Heo | 345/88 |

FOREIGN PATENT DOCUMENTS

JP 2001-159871 * 6/2001

* cited by examiner

*Primary Examiner* — Nitin Patel
(74) *Attorney, Agent, or Firm* — Brinks Hofer Gilson & Lione

(57) ABSTRACT

A liquid crystal display system is provided where a light irradiated onto each pixel provided at a liquid crystal display panel can be divided for each frame interval to selectively transmit and absorb the divided light. A liquid crystal display device includes a liquid crystal display panel and a timing controller that controls switching of a light transmission area and a light absorption area of the plurality of pixels for each frame interval. A liquid crystal shutter selectively absorbs and transmits a light irradiated onto each pixel for each frame interval. Electrode lines provided in a horizontal direction are symmetrically arranged at a front side of the liquid crystal display panel. The electrode lines makes a pair to be positioned at the front side of each pixel in the horizontal direction. A shutter driver alternately supplies a current to the pair of electrode lines positioned at the front side of each pixel in response to a control of the timing controller.

8 Claims, 8 Drawing Sheets

LIQUID CRYSTAL DISPLAY AND DRIVING METHOD THEREOF

This application claims the benefit of Korean Patent Application No. P2005-0130802 filed on Dec. 27, 2005 which is hereby incorporated by reference.

BACKGROUND OF THE INVENTION

1. Technical Field

This invention relates to a liquid crystal display, and more particularly to a liquid crystal display and a driving method thereof where a light irradiated onto each pixel provided at a liquid crystal display panel can be divided for each frame interval to thereby selectively transmit and absorb the divided light.

2. Description of the Related Art

Generally, a liquid crystal display (LCD) controls light transmittance of liquid crystal cells in accordance with video signals to there by display a picture. An active matrix type of liquid crystal display device having a switching device provided for each liquid crystal cell is advantageous for an implementation of moving picture because it permits an active control of the switching device. The switching device used for the active matrix liquid crystal display device mainly employs a thin film transistor (TFT) as shown in FIG. 1.

Referring to FIG. 1, the active matrix LCD converts a digital input data into an analog data voltage based on a gamma reference voltage to supply the analog data voltage to a data line DL and, at the same time, supplies a scanning pulse to a gate line GL to thereby charge a liquid crystal cell Clc.

A gate electrode of the TFT is connected to the gate line GL while a source electrode thereof is connected to the data line DL. Further, a drain electrode of the TFT is connected to a pixel electrode of the liquid crystal cell Clc and to one electrode of a storage capacitor Cst.

A common electrode of the liquid crystal cell Clc is supplied with a common voltage Vcom.

The storage capacitor Cst charges a data voltage fed from the data line DL when the TFT is turned on, thereby constantly keeping a voltage at the liquid crystal cell Clc.

If the scanning pulse is applied to the gate line GL, then the TFT is turned on to provide a channel between the source electrode and the drain electrode thereof, thereby supplying a voltage on the data line DL to the pixel electrode of the liquid crystal cell Clc. Liquid crystal molecules of the liquid crystal cell have an alignment changed by an electric field between the pixel electrode and the common electrode to thereby modulate an incident light.

A configuration of the related art LCD including pixels having the above-mentioned structure will be described with reference to FIG. 2. FIG. 2 is a block diagram showing a configuration of a general liquid crystal display device. Referring to FIG. 2, a general liquid crystal display device 100 includes a liquid crystal display panel 110 provided with a thin film transistor (TFT) for driving the liquid crystal cell Clc at an intersection of data lines DL1 to DLm and gate lines GL1 to GLn crossing each other, a data driver 120 for supplying a data to the data lines DL1 to DLm of the liquid crystal display panel 110, a gate driver 130 for supplying a scanning pulse to the gate lines GL1 to GLn of the liquid crystal display panel 110, a gamma reference voltage generator 140 for generating a gamma reference voltage to supply it to the data driver 120, a backlight assembly 150 for irradiating a light onto the liquid crystal display panel 110, an inverter 160 for applying an alternating current voltage and a current to the back light assembly 160, a common voltage generator 170 for generating a common voltage Vcom to supply them to the common electrode of the liquid crystal cell Clc of the liquid crystal display panel 110, a gate driving voltage generator 180 for generating a gate high voltage VGH and a gate low voltage VGL to supply them to the gate driver 130, and a timing controller 190 for controlling the data driver 120 and the gate driver 130.

The liquid crystal display panel 110 has a liquid crystal injected between two glass substrates. On the lower glass substrate of the liquid crystal display panel 110, the data lines DL1 to DLm and the gate lines GL1 to GLn perpendicularly cross each other. Each intersection between the data lines DL1 to DLm and the gate lines GL1 to GLn is provided with the TFT. The TFT supplies a data on the data lines DL1 to DLm to the liquid crystal cell Clc in response to the scanning pulse. The gate electrode of the TFT is connected to the gate lines GL1 to GLn while the source electrode thereof is connected to the data line DL1 to DLm. Further, the drain electrode of the TFT is connected to the pixel electrode of the liquid crystal cell Clc and to the storage capacitor Cst.

The TFT is turned on in response to the scanning pulse applied, via the gate lines GL1 to GLn, to the gate terminal thereof. Upon turning-on of the TFT, a video data on the data lines DL1 to DLm is supplied to the pixel electrode of the liquid crystal cell Clc.

The data driver 120 supplies a data to the data lines DL1 to DLm in response to a data driving control signal DDC from the timing controller 190. Further, the data driver 120 samples and latches a digital video data RGB fed from the timing controller 190, and then converts it into an analog data voltage capable of expressing a gray scale level at the liquid crystal cell Clc of the liquid crystal display panel 110 on a basis of a gamma reference voltage from the gamma reference voltage generator 140, thereby supplying it the data lines DL1 to DLm.

The gate driver 130 sequentially generates a scanning pulse, that is, a gate pulse in response to a gate driving control signal GDC and a gate shift clock GSC from the timing controller 190 to supply them to the gate lines GL1 to GLn. At this time, the gate driver 130 determines a high level voltage and a low level voltage of the scanning pulse in accordance with the gate high voltage VGH and the gate low voltage VGL from the gate driving voltage generator 180.

The gamma reference voltage generator 140 receives a power voltage Vcc of 0V to 3.3V supplied from a system mounted with the liquid crystal display device 100, for example, a controller (not shown) of an image display equipment such as a television receiver to thereby generate a positive gamma reference voltage and a negative gamma reference voltage, and outputs them to the data driver 120.

The backlight assembly 150 is provided at the rear side of the liquid crystal display panel 110, and is radiated by an alternating current voltage and a current supplied to the inverter 160 to irradiate a light onto each pixel of the liquid crystal display panel 110.

The inverter 160 converts a rectangular wave signal generated at the interior thereof into a triangular wave signal and then compares the triangular wave signal with a direct current power voltage Vcc supplied from said system, thereby generating a burst dimming signal proportional to a result of the comparison. If the burst dimming signal determined in accordance with the rectangular wave signal at the interior of the inverter 160, then a driving integrated circuit (IC) for controlling a generation of the AC voltage and current within the inverter 160 controls a generation of AC voltage and current supplied to the backlight assembly 150 in response to the burst dimming signal.

The common voltage generator 170 receives a high-level power voltage VDD to generate a common voltage Vcom, and supplies it to the common electrode of the liquid crystal cell Clc provided at each pixel of the liquid crystal display panel 110.

The gate driving voltage generator 180 is supplied with a high-level power voltage VDD to generate the gate high voltage VGH and the gate low voltage VGL, and supplies them to the data driver 130. Herein, the gate driving voltage generator 180 generates a gate high voltage VGH more than a threshold voltage of the TFT provided at each pixel of the liquid crystal display panel 110 and a gate low voltage VGL less then the threshold voltage of the TFT. The gate high voltage VGH and the gate low voltage VGL generated in this manner are used for determining a high level voltage and a low level voltage of the scanning pulse generated by the gate driver 130, respectively.

The timing controller 190 supplies a digital video data RGB from a digital video card (not shown) to the data driver 120 and, at the same time, generates a data driving control signal DCC and a gate driving control signal GDC using horizontal/vertical synchronizing signals H and V in response to a clock signal CLK to supply them to the data driver 120 and the gate driver 130, respectively. Herein, the data driving control signal DDC includes a source shift clock SSC, a source start pulse SSP, a polarity control signal POL and a source output enable signal SOE, etc. The gate driving control signal GDC includes a gate start pulse GSP and a gate output enable signal GOE, etc.

A structure of a color filter provided at the related art liquid crystal display device having the above-mentioned configuration and function will be described with reference to FIG. 3 below.

FIG. 3 depicts a structure of a color filter in the related art liquid crystal display device. Herein, FIG. 3 illustrates a structure of RGB color filters of each pixel provided at the liquid crystal display panel 110.

As shown in FIG. 3, a plurality of pixels provided at the liquid crystal display panel 110 has one RGB color filter, respectively. The pixel consists of three sub-pixels. The three sub-pixels are provided with a R color filter, a G color filter and a B color filter, respectively, and are provided a thin film transistor TFT corresponding to each color filter.

In the case of the related art liquid crystal display device as described above, a number of pixels are provided on the liquid crystal display panel by intersections between the gate lines and the data lines. Also, the number of gate lines and thin film transistors provided at the liquid crystal display panel 110 has been increased in proportion to the number of pixels. Therefore, in the related art liquid crystal display device, an aperture ratio is reduced in proportion to the number of gate lines and thin film transistors provided at the liquid crystal display panel 110, and hence brightness also is reduced.

BRIEF SUMMARY

A liquid crystal display system is provided where a light irradiated onto each pixel provided at a liquid crystal display panel can be divided for each frame interval to selectively transmit and absorb the divided light.

The liquid crystal display may thereby reduce a frame interval by half.

The liquid crystal display device includes a liquid crystal display panel, a timing controller that controls a switching of a light transmission area and a light absorption area of pixels for each frame interval. A liquid crystal shutter is provided that selectively absorbs and transmits a light irradiated onto each pixel for each frame interval, and a plurality of electrode lines are provided in a horizontal direction and symmetrically arranged at a front side of the liquid crystal display panel. The plurality of electrode lines make a pair two by two to be positioned at the front side of each pixel in the horizontal direction. A shutter driver is provided that alternately supplies a current to the pair of electrode lines positioned at the front side of each pixel in response to a control of the timing controller.

BRIEF DESCRIPTION OF THE DRAWINGS

These and other objects of the invention will be apparent from the following detailed description of the embodiments of the present invention with reference to the accompanying drawings, in which.

DETAILED DESCRIPTION

Figure 4:
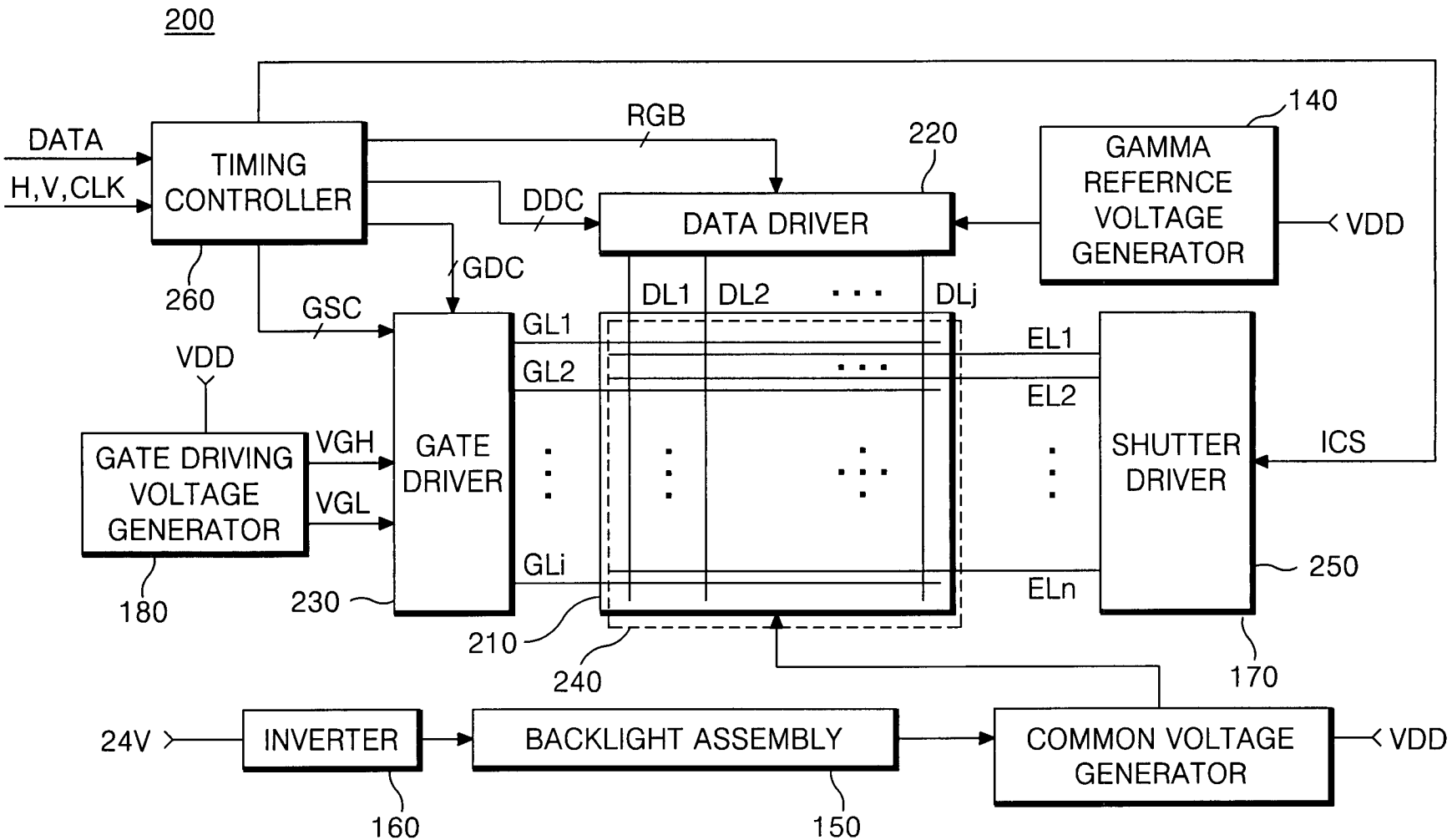
FIG. 4 is a block diagram showing a configuration of a liquid crystal display device.

FIG. 4 shows a configuration of a liquid crystal display device.

Figure 1:
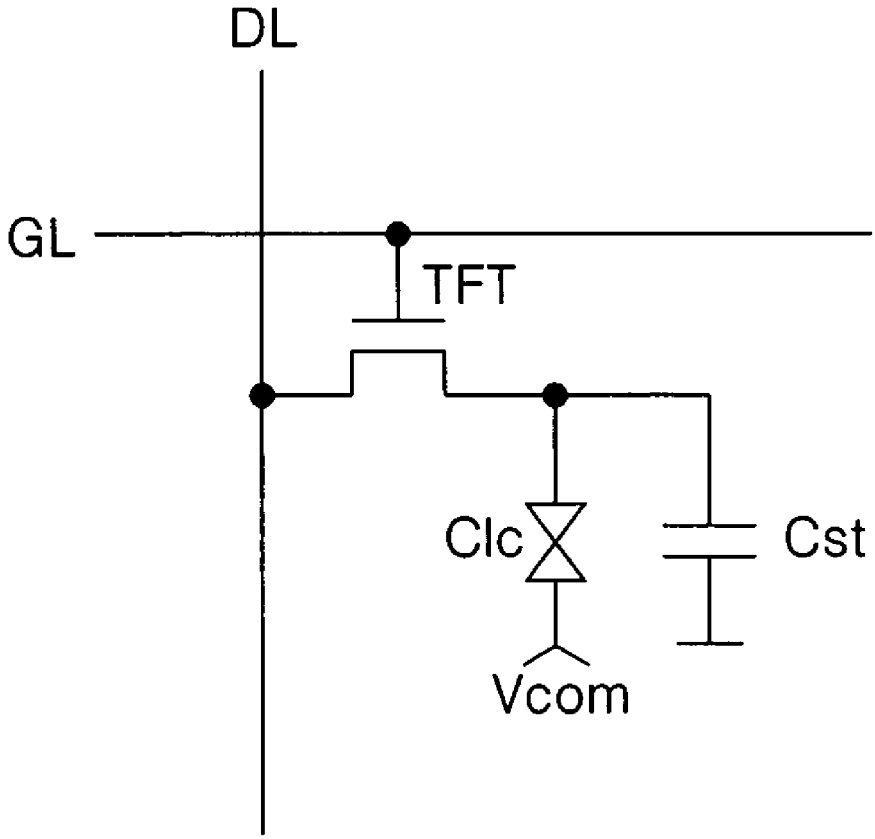
FIG. 1 RELATED ART
FIG. 1 is an equivalent circuit diagram of a pixel provided at a general liquid crystal display device.
Figure 2:
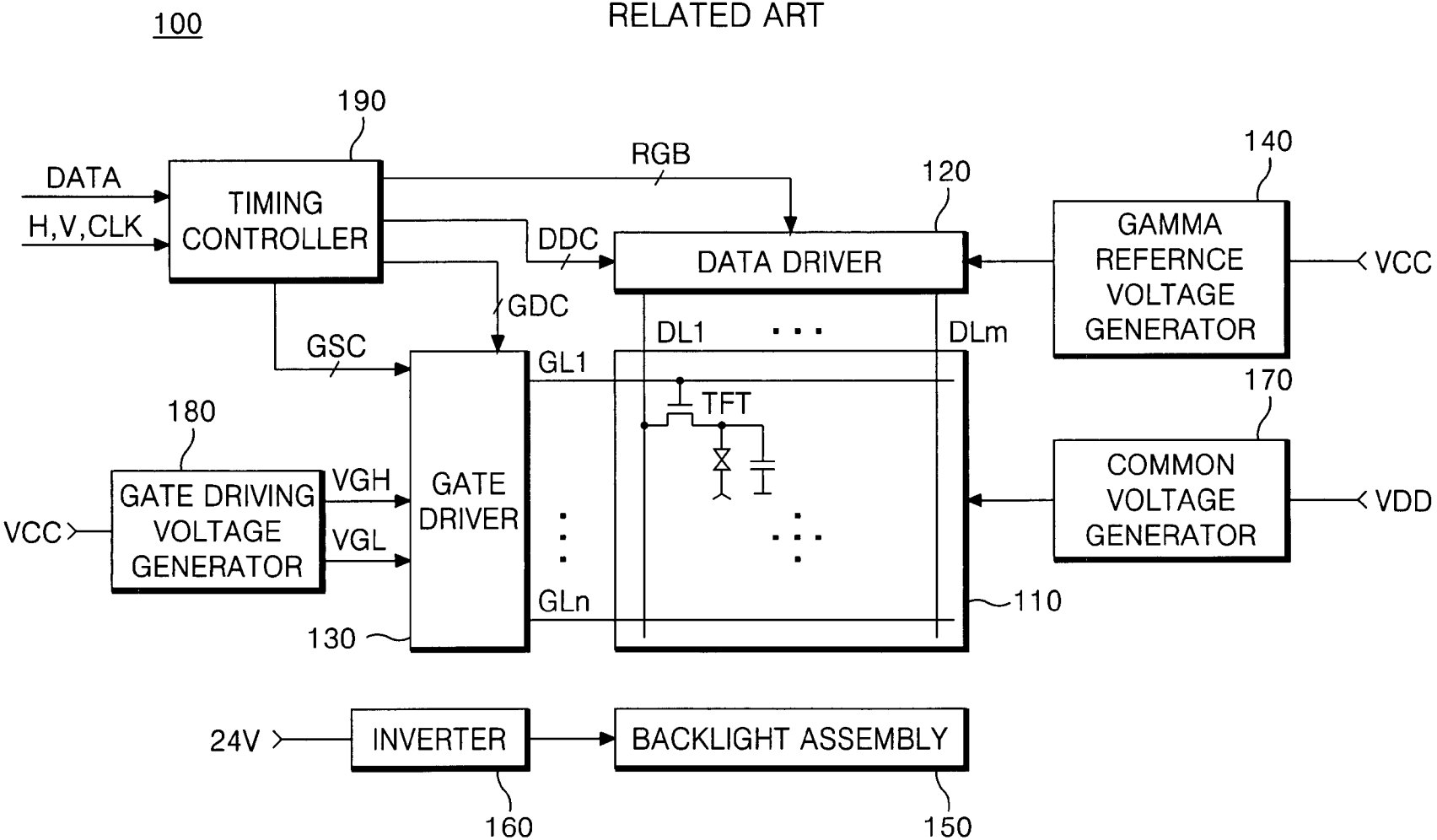
FIG.2 RELATED ART
FIG. 2 is a block diagram showing a configuration of a related art liquid crystal display device.
Figure 3:
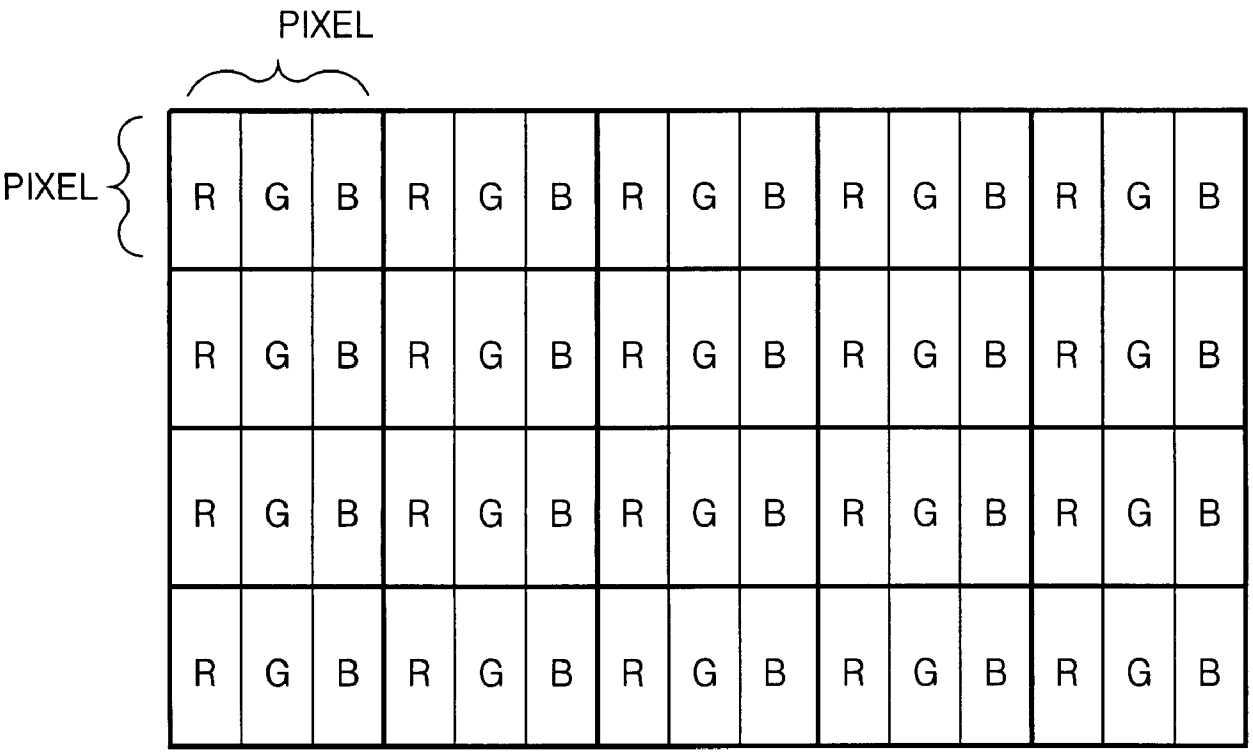
FIG. 3 RELATED ART
FIG. 3 depicts a structure of a color filter in the related art liquid crystal display device.

Referring to FIG. 4, the liquid crystal display device 200 includes a gamma reference voltage generator 140, a backlight assembly 150, an inverter 160, a common voltage generator 170 and a gate driving voltage generator 180 likewise the liquid crystal display device 100 as shown in FIG. 1.

Further, the liquid crystal display device 200 includes a liquid crystal display panel 210 having pixels provided by intersections between data lines DL1 to DLj and gate lines GL1 to GLi and having thin film transistors (TFT's) provided at each pixel to drive a liquid crystal cell Clc, a data driver 220 for supplying a data to the data lines DL1 to DLj of the liquid crystal display panel 210, a gate driver 230 for supplying a scanning pulse to the gate lines GL1 to GLi of the liquid crystal display panel 210, a liquid crystal shutter 240 provided with electrode lines EL1 to ELn and symmetrically arranged at a front side of the liquid crystal display panel 210 to divide a light irradiated onto each pixel for each frame interval, thereby selectively absorbing and transmitting the divided light, and a shutter driver 250 for supplying a current to the electrode lines EL1 to ELn, and a timing controller 260 for controlling a driving of the data driver 220, the gate driver 230 and the shutter driver 250.

The liquid crystal display panel 210 has a liquid crystal injected between two glass substrates. On the lower glass substrate of the liquid crystal display panel 210, the data lines DL1 to DLj and the gate lines GL1 to GLi perpendicularly cross each other. Each intersection between the data lines DL1 to DLj and the gate lines GL1 to GLi is provided with the TFT. The TFT supplies a data on the data lines DL1 to DLj to the liquid crystal cell Clc in response to the scanning pulse. The gate electrode of the TFT is connected to the gate lines GL1 to GLi while the source electrode thereof is connected to the data line DL1 to DLj. Further, the drain electrode of the TFT is connected to the pixel electrode of the liquid crystal cell Clc and to the storage capacitor Cst.

The TFT is turned on in response to the scanning pulse applied, via the gate lines GL1 to GLi, to the gate terminal thereof. Upon turning-on of the TFT, a video data on the data lines DL1 to DLj is supplied to the pixel electrode of the liquid crystal cell Clc.

Particularly, since the number of pixels provided at the liquid crystal display panel 210 in the liquid crystal display device according to the present invention corresponds to a half of the number of pixels provided at the liquid crystal display panel 110 shown in FIG. 1, the number of gate lines GL1 to GLi provided at the present liquid crystal display panel 210 corresponds to a half of the number of gate lines GL1 to GLn provided at the liquid crystal display panel 110 shown in FIG. 1. Thus, the number of provided at the liquid crystal display panel 210 also is reduced to a half of the number of pixels provided at the liquid crystal display panel 110 shown in FIG. 1. However, since the liquid crystal display panel 210 has the same size as the liquid crystal display panel 110 shown in FIG. 1, total area of pixels provided at the liquid crystal display panel 210 is twice larger than that of pixels provided at the liquid crystal display panel 110 shown in FIG. 1.

The data driver 220 supplies a data to the data lines DL1 to DLj in response to a data driving control signal DDC from the timing controller 260. Further, the data driver 220 samples and latches a digital video data RGB from the timing controller 190, and then converts it into an analog data voltage capable of expressing a gray scale level at the liquid crystal cell Clc of the liquid crystal display panel 110 on a basis of a gamma reference voltage from the gamma reference voltage generator 140, thereby supplying it the data lines DL1 to DLj. Herein, the number of pixels supplied with an analog data by the data driver 220 corresponds to a half of the number of pixels supplied with an analog data by the data driver 120 in FIG. 1, so that the data driver 120 in FIG. 1 supplies all data to the data lines DL1 to DLm during 1/60 second (60 Hz), that is, during one frame interval while the data driver 220 supplies all data to the data lines DL1 to DLj during 1/120 second (120 Hz), that is, during one frame interval.

The gate driver 230 sequentially generates a scanning pulse, that is, a gate pulse in response to a gate driving control signal GDC and a gate shift clock GSC from the timing controller 260 to supply them to the gate lines GL1 to GLi. At this time, the gate driver 230 determines a high level voltage and a low level voltage of the scanning pulse in accordance with the gate high voltage VGH and the gate low voltage VGL from the gate driving voltage generator 180. Herein, the number of gate lines GL1 to GLi driven by the gate driver 230 corresponds to a half of the number of gate lines GL1 to GLn driven by the gate driver 130 in FIG. 1, so that the gate driver 130 in FIG. 1 sequentially supplies all scanning pulses to the gate lines GL1 to GLn during 1/60 second (60 Hz), that is, during one frame interval while the gate driver 230 sequentially supplies all scanning pulses to the gate lines GL1 to GLi during 1/120 second (120 Hz), that is, during one frame interval. One frame interval of the liquid crystal display panel 210 disclosed is 120 Hz.

The liquid crystal shutter 240 has a liquid crystal injected between two glass substrates along the electrode lines EL1 to ELn arranged horizontally. Such a liquid crystal shutter 240 is symmetrically arranged at the front side of the liquid crystal display panel 210. Herein, the electrode lines EL1 to ELn provided at the liquid crystal shutter 240 make a pair two by two to be arranged at the front side of the pixels in the horizontal direction.

Figure 5A:
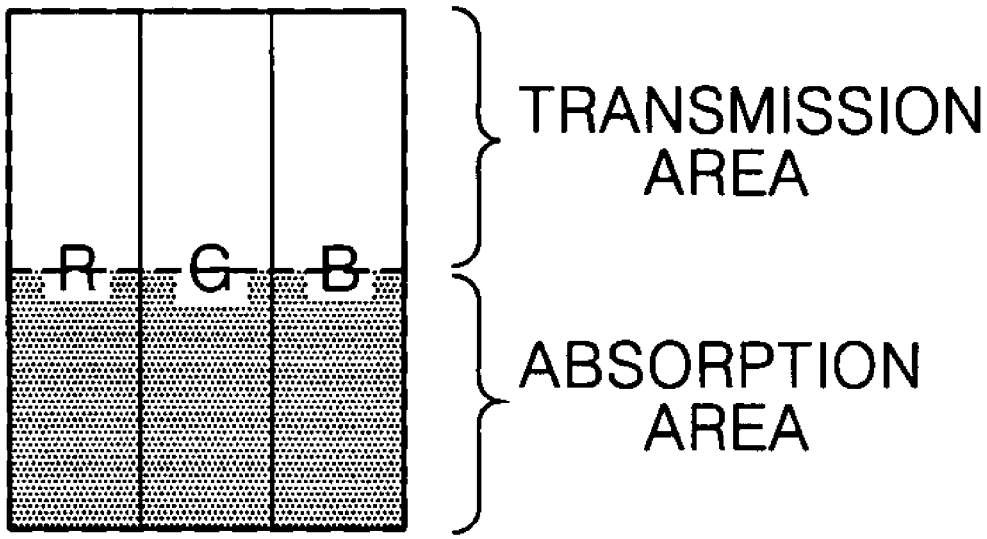
FIG. 5A and FIG. 5B illustrate a light transmission state of a pixel provided at the liquid crystal display device shown in FIG. 4.
Figure 5B:
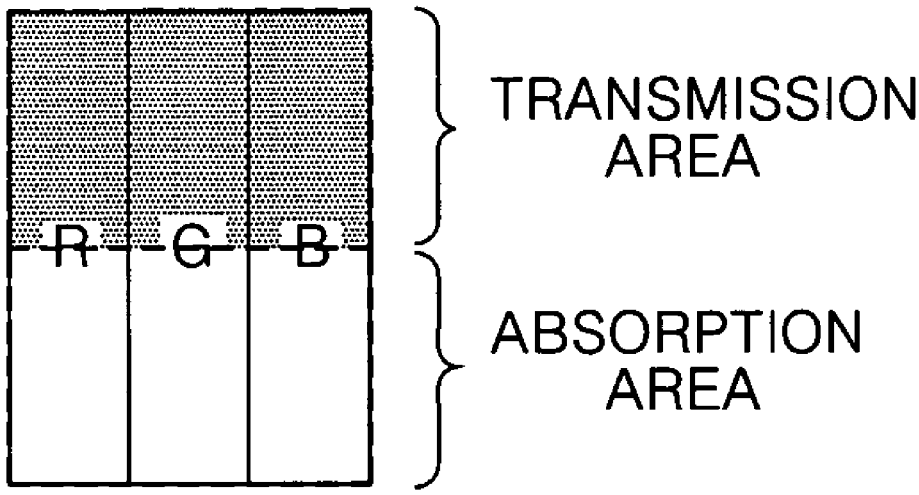

Thus, transmission and absorption of a light irradiated from the backlight assembly 150 onto each pixel are controlled by means of the liquid crystal shutter 240. Specifically, if a current from the shutter driver 250 is applied to the electrode lines positioned at the upper portion, of a pair of electrode lines arranged at the front side of one pixel, then only a liquid crystal injected along the upper electrode line is driven while a liquid crystal injected along the lower electrode line is not driven. Thus, as shown in FIG. 5A, only a light irradiated from the center portion of the corresponding pixel onto the upper area thereof is transmitted while a light irradiated onto the lower area thereof is absorbed into the liquid crystal shutter 240. After a frame of the liquid crystal display panel 210 was changed in a state as shown in FIG. 5A, if the shutter driver 250 shuts off a current application of the electrode line positioned at the upper portion, of a pair of electrode lines arranged at the front side of one pixel, in response to a current application control signal ICS from the timing controller 260 and, at the same time, if the shutter driver 250 supplies a current to the electrode line positioned at the lower portion, then only a liquid crystal injected along the lower electrode line is driven while a liquid crystal injected along the upper electrode line is not driven. Thus, as shown in FIG. 5B, only a light irradiated from the center portion of the corresponding pixel onto the lower area is transmitted while a light irradiated onto the upper area is absorbed into the liquid crystal shutter 240. As shown in FIG. 5A and FIG. 5B, each pixel provided at the liquid crystal display panel 210 is divided into a transmission area and an absorption area in the horizontal direction, each of which is switched for each frame interval.

Figure 6:
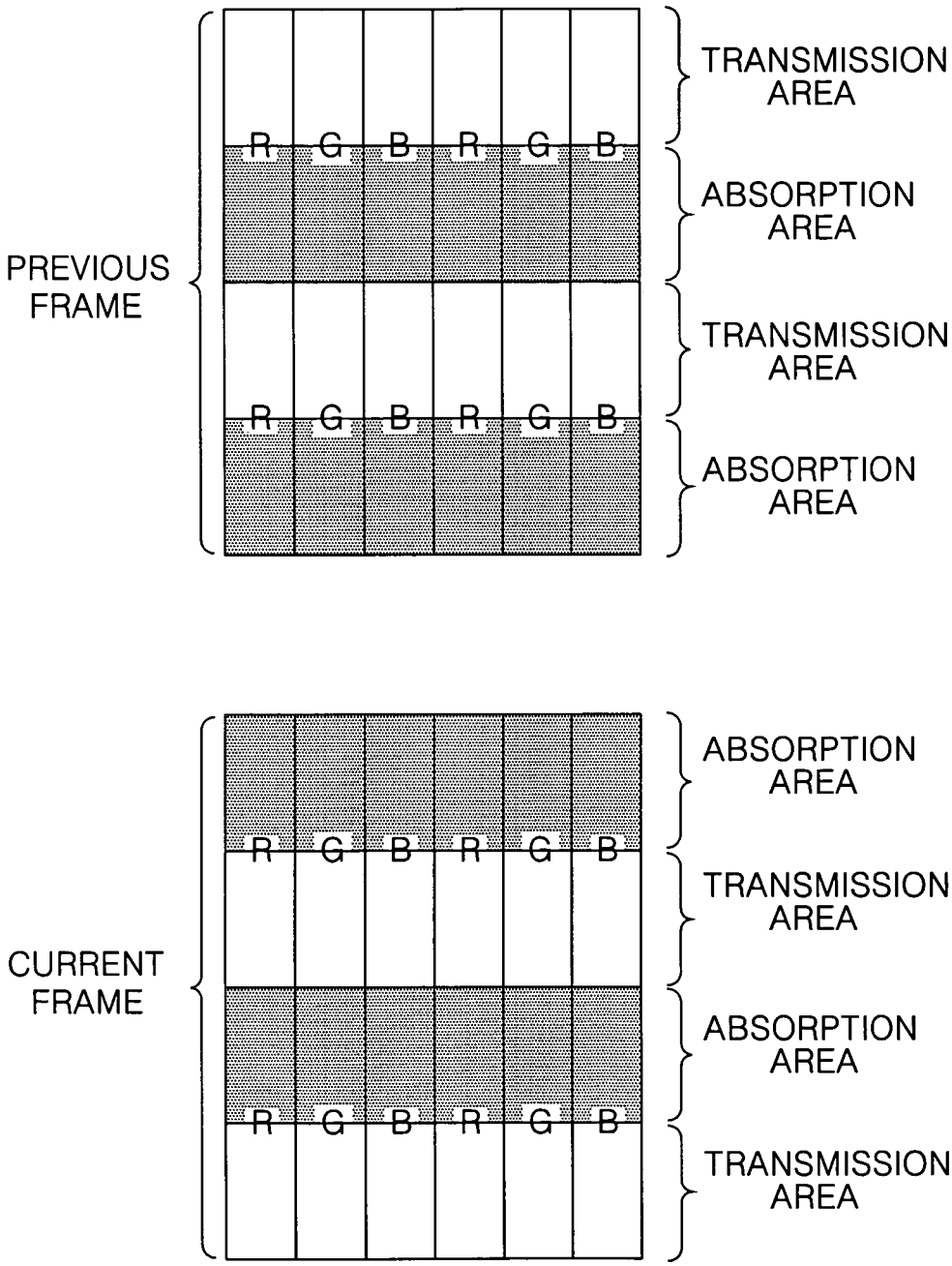
FIG. 6 illustrates a light transmission state for each frame in the liquid crystal display device shown in FIG. 4.

The shutter driver 250 alternately supplies a current to a pair of electrode lines positioned at the front side of one pixel for each frame interval in response to the current application control signal ICS from the timing controller 200, so that the transmission area and the absorption area of each pixel are switched at the current frame and the previous frame as shown in FIG. 6.

The timing controller 260 supplies a digital video data RGB from a digital video card (not shown) to the data driver 220 and, at the same time, generates a data driving control signal DCC and a gate driving control signal GDC using horizontal/vertical synchronizing signals H and V in response to a clock signal CLK to supply them to the data driver 220 and the gate driver 230, respectively. Herein, the data driving control signal DDC includes a source shift clock SSC, a source start pulse SSP, a polarity control signal POL and a source output enable signal SOE, or other signals. The gate driving control signal GDC includes a gate start pulse GSP and a gate output enable signal GOE, or other signals.

Further, the timing controller 260 supplies the current application control signal ICS to thereby alternately apply a current to the electrode lines EL1 to ELn provided at the liquid crystal shutter 240. The timing controller 260 controls the shutter driver 250 such that a current is alternately applied to a pair of electrode lines arranged at the front side of one pixel for each frame interval.

Figure 7:
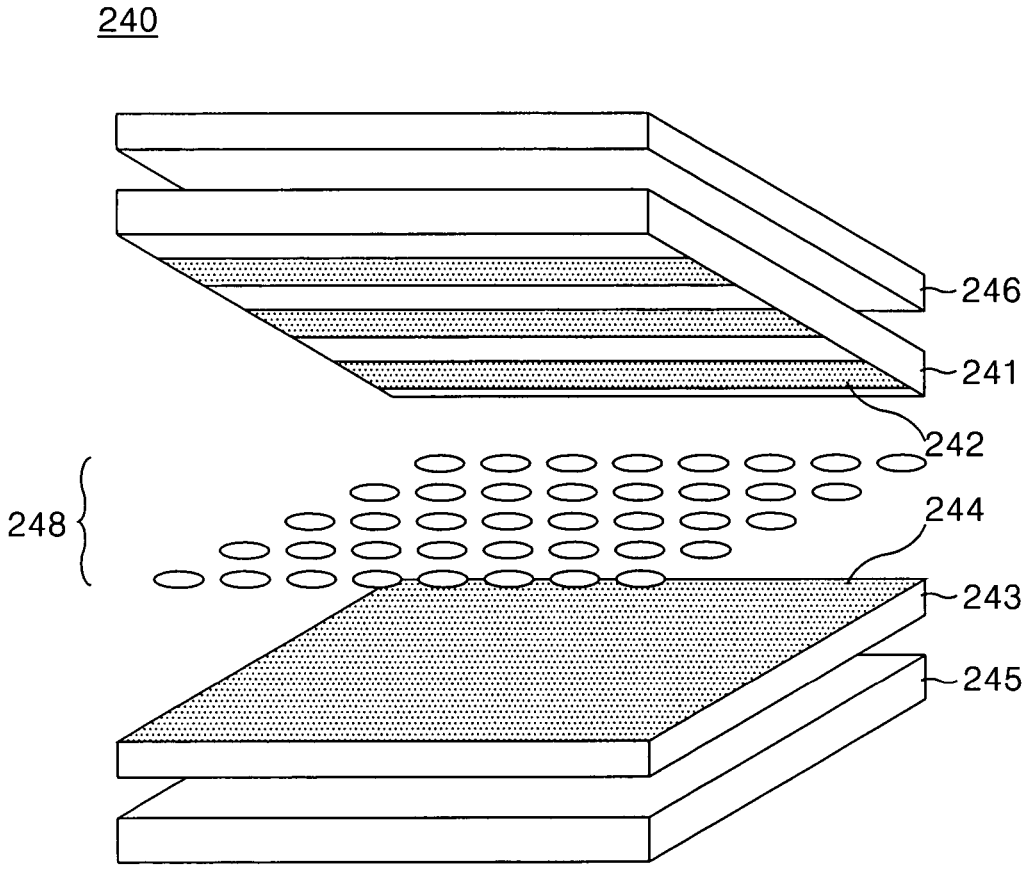
FIG. 7 is a fragmental perspective view showing a structure of a liquid crystal shutter applicable to the liquid crystal display panel.

FIG. 7 is a fragmental perspective view showing a structure of a liquid crystal shutter applicable to the liquid crystal display panel.

Referring to FIG. 7, the liquid crystal shutter 240 includes a row line electrode pattern 242 provided on an upper transparent substrate 241, a common electrode 244 provided on a lower transparent substrate 243, and absorbing polarizers 245 and 246 attached onto the upper transparent substrate 241 and the lower transparent substrate 243, respectively.

The upper transparent substrate 241 and the lower transparent substrate 243 are made from a transparent glass substrate or a transparent plastic substrate. A liquid crystal 248 for delaying a phase of the light by a range of $0\sim\lambda/2$ in accordance with a voltage is injected between the upper transparent substrate 241 and the lower transparent substrate 243. Herein, $\lambda$ represents a wavelength of the light.

The liquid crystal 248 may be selected from any one of a VA (vertical aligned mode) liquid crystal, an ECB (electrically controllable birefringence) liquid crystal and a FLC (Ferro-electric liquid crystal).

The row line electrode pattern 242 has a width set to a size covering tens of to hundreds of liquid crystal cells provided at the liquid crystal display panel 210, and takes a stripe shape.

The row line electrode pattern 242 is formed from a transparent conductive material, for example, ITO (indium-tin-oxide), IZO (indium-zinc-oxide) or ITZO (indium-tin-zinc-oxide), etc. to thereby transmit a light.

As described above, a light irradiated onto each pixel provided at the liquid crystal display panel is selectively transmitted and absorbed for each frame interval, so that the frame interval can be shortened to a half one and the number of pixels provided at the liquid crystal display panel can be reduced to a half. Thus, the number of gate lines provided at the liquid crystal panel as well as the number of thin film transistors provided at each pixel can be reduced to a half, respectively. Accordingly, it becomes possible to considerably increase an aperture ratio of each pixel and hence dramatically enhance brightness thereof.

Although the disclosure has been explained in relation to the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A liquid crystal display device, comprising:

a liquid crystal display panel having a plurality of gate lines and a plurality of data lines;

a timing controller operable to control switching of a light transmission area and a light absorption area for a frame interval;

a liquid crystal shutter operable to selectively absorb and transmit a light irradiated onto a pixel for the frame interval, wherein a plurality of electrode lines are provided in a horizontal direction and are symmetrically arranged at a front side of the liquid crystal display panel, and wherein the plurality of electrode lines include a pair of positioned at a front side of the pixel in the horizontal direction; and a shutter driver operable to alternately supply a current to the pair of electrode lines positioned at the front side of the pixel in response to a control of the timing controller, wherein the liquid crystal shutter includes an upper transparent substrate, a lower transparent substrate, absorbing polarizers attached onto the upper transparent substrate and the lower transparent substrate respectively and a liquid crystal for delaying a phase of the light in accordance with a voltage is injected between the upper transparent substrate and the lower transparent substrate, wherein the frame interval is 120 Hz (1/20 second), wherein the plurality of electrode lines is parallel to the plurality of gate lines, wherein the shutter driver is operable to shut off a current application into one electrode line to which a current is fed at the previous frame, for a pair of electrode lines positioned at the front side of each pixel and operable to apply a current to another electrode line in response to a control of the timing controller.

2. The liquid crystal display device as claimed in claim 1, wherein the timing controller is operable to control the shutter driver such that a light transmission area and a light absorption area of a pixel at a previous frame are switched at a current frame.

3. The liquid crystal display device as claimed in claim 1, wherein the liquid crystal shutter drives the liquid crystal injected along the electrode line and supplied with a current to thereby transmit a light irradiated onto a pixel area related to a corresponding electrode line, and does not drive a liquid crystal injected along the electrode line not supplied with a current to thereby absorb a light irradiated onto a pixel area related to the corresponding electrode line.

4. The liquid crystal display device as claimed in claim 1, wherein the light transmission area and the light absorption area are equally divided into two areas at an upper portion and a lower portion thereof to be switched for each frame interval.

5. A method of driving a liquid crystal display device having a liquid crystal shutter provided a plurality of electrode lines and symmetrically arranged at a front side of a liquid crystal display panel having a plurality of gate lines and a plurality of data lines to divide a light irradiated onto a plurality of pixels for each frame interval, comprising:

irradiating the light onto the plurality of pixels provided at the liquid crystal display panel;

dividing the light transmission area and the light absorption area of the plurality of pixels into two areas at the upper portion and the lower portion thereof to be switched for each frame interval; and transmitting one portion of the light irradiated onto each pixel while absorbing another portion of the irradiated light, wherein each pixel is divided into a light transmission area and a light absorption area to transmit and absorb the irradiated light, the light transmission area and the light absorption area of each pixel switched when a frame is changed, wherein the liquid crystal shutter includes an upper transparent substrate, a lower transparent substrate, absorbing polarizers attached onto the upper transparent substrate and the lower transparent substrate respectively and a liquid crystal for delaying a phase of the light in accordance with a voltage is injected between the upper transparent substrate and the lower transparent substrate, wherein the frame interval is 120 Hz (1/20 second), wherein a plurality of electrode lines are provided in a horizontal direction and are symmetrically arranged at a front side of the liquid crystal display panel, and wherein the plurality of electrode lines include a pair of positioned at a front side of the pixel in the horizontal direction, wherein the plurality of electrode lines is parallel to the plurality of gate lines.

6. The method as claimed in claim 5, wherein transmitting includes:

allowing a light transmission area and a light absorption area of each pixel at a previous frame is switched at a current frame.

7. The method as claimed in claim 5, wherein transmitting includes:

shutting off a current application into one electrode line to which a current is fed at a previous frame, of a pair of electrode lines positioned at a front side of each pixel and, at the same time, applying a current to another electrode line.

8. The method as claimed in claim 5, wherein transmitting includes:

driving a liquid crystal injected along a electrode line supplied with a current to thereby transmit a light irradiated onto a pixel area related to a corresponding electrode line while not driving a liquid crystal injected along a electrode line not supplied with a current to thereby absorb a light irradiated onto a pixel area related to the corresponding electrode line.

* * * * *